US005564346A

United States Patent [19]

Robben

[11] Patent Number: 5,564,346

[45] Date of Patent: Oct. 15, 1996

[54] ERGONOMIC ADJUSTABLE WORKSTAND

[76] Inventor: Raymond M. Robben, 6075 N. Dearborn Rd., Guilford, Ind. 47022

[21] Appl. No.: 361,860

[22] Filed: Dec. 22, 1994

Related U.S. Application Data

[63] Continuation of Ser. No. 22,325, Feb. 25, 1993, abandoned.

[51] Int. Cl.[6] ..... A47B 9/00

[52] U.S. Cl. ..... 108/108; 211/187

[58] Field of Search ..... 108/108, 144, 108/152; 211/187, 193; 248/297.3, 297.5, 246, 243

[56] References Cited

U.S. PATENT DOCUMENTS

| | | | |
|---|---|---|---|
| 291,030 | 1/1884 | Clapper . | |
| 652,836 | 7/1900 | Covert . | |
| 730,894 | 6/1903 | Fairbanks et al. . | |
| 845,917 | 3/1907 | Worley et al. . | |
| 1,826,643 | 10/1931 | Anderson . | |
| 2,792,164 | 5/1957 | Cauffiel . | |
| 3,347,187 | 10/1967 | Khoury . | |
| 3,601,256 | 8/1971 | Bowers, Jr. et al. . | |
| 4,250,815 | 2/1981 | Swanson | 248/243 |
| 4,373,508 | 2/1983 | Worthcraft | 248/246 |
| 4,444,323 | 4/1984 | Travis . | |
| 5,054,404 | 10/1991 | Melgers . | |
| 5,111,908 | 5/1992 | Reiter et al. . | |
| 5,119,907 | 6/1992 | Billington, III et al. . | |
| 5,131,503 | 7/1992 | Billington, III et al. . | |
| 5,158,157 | 10/1992 | Billington, III et al. . | |
| 5,217,090 | 6/1993 | Billington, III et al. . | |
| 5,365,860 | 11/1994 | Billington, III . | |

FOREIGN PATENT DOCUMENTS

| | | | |
|---|---|---|---|
| 0087779 | 9/1983 | European Pat. Off. | 248/246 |
| 0673445 | 1/1930 | France | 108/144 |
| 318541 | 6/1934 | Italy . | |

*Primary Examiner*—Peter M. Cuomo
*Assistant Examiner*—Gerald A. Anderson
*Attorney, Agent, or Firm*—Dinsmore & Shohl

[57] ABSTRACT

An improved adjustable height workstand having a base with a front face, a pair of upstanding support columns adjacent that front face, and an adjustable platform having a front end and a relatively planar tread surface which can be adjustably fixed at a plurality of predetermined vertical heights. The support columns include a plurality of vertically spaced and rearwardly extending adjustment slots, and the adjustable platform includes a pair of oppositely disposed adjustment members located adjacent the front end of the platform. The adjustment members each include an outwardly extending locking pin and a second locking member. The pin is selectively received in a corresponding adjustment slot and also enables rotation of the adjustable platform relative to the support columns. When the platform is in substantially horizontal, or use, position, the second locking member contacts a rearward facing portion of the support column to rigidly hold the tread surface against further rotation. When vertical adjustment is desired, the support platform is rotated upwardly and toward the front of the workstand to release the second locking member and enable vertical adjustment of the platform, whereby the pins can be moved to other adjustment slots, as desired.

16 Claims, 3 Drawing Sheets

ERGONOMIC ADJUSTABLE WORKSTAND

This is a continuation of application Ser. No. 08/022,325, filed Feb. 25, 1993, now abandoned.

TECHNICAL FIELD

This invention relates to an improved adjustable workstand for providing a conveniently adjustable work platform for a variety of applications, and, more particularly, to an ergonomically designed adjustable workstand which features a rotatable platform having a pair of oppositely disposed adjustment members which provides rocking-type rigid locking capabilities and simple, unlocking for ergonomically improved adjustment.

BACKGROUND ART

In many applications, such as with manufacturing assembly lines and the like, there is continual need for the provision of safe, convenient and adjustable work platforms for workers. These platforms must be adjustable to adapt to varying applications and to accommodate workers of various stature and work height preferences. These work platforms have previously been provided in the form of custom built devices made from a variety of materials such as wood, metal, etc.

Adjustable work platforms have also been provided in the form of platform bases having two or more upstanding support members and a selectively adjustable platform attached to those support members. For example, adjustable workstands available in the industry have been available with platforms which are disengageable from upstanding support members, and which can be reattached at differing vertical levels as desired. These workstands have, however, generally been relatively heavy in order to provide adequate and reliable support, and were generally difficult to adjust. In many such devices, adjustment might entail moving the workstand away from the workstation in order to access the platform attachment points for adjustment. In other cases, several workers were required to effect the adjustment changes due to the cumbersome, nature of the platform and stand assembly. Consequently, while adjustable work platforms have been available in the industry, their designs have been relatively complex and/or cumbersome and adjustment procedures have been inconvenient, unwieldy, and generally obstructive to optimal application in the workplace.

Adjustable supports and platforms have also been available in a variety of other applications, such as the tailor's measure shown in U.S. Pat. No. 730,894, issued to M. Fairbanks et al. In this construction, a platform was vertically adjustable and held in place with a set screw, bracket, and sleeve combination surrounding a single central upright. The set screw was loosened to enable adjustment, and thereafter tightened to prevent further movement once adjustment was complete. In another example, adjustable storage racks are shown in U.S. Pat. No. 4,444,323 (which issued to M. Travis), wherein a pair of support column members are mounted on a frame via a pair of generally U-shaped brackets which fit over the support columns. Pairs of inwardly directed pins were provided on the brackets to lockingly engage corresponding slots formed in the columns, and the pins and brackets can be removed from the slots by upward and outward movement of the brackets, thereby extracting the bayonet pins from the slots. Each bracket is shown as including several pairs of vertically spaced pins to stabilize the brackets in locked position.

As will be understood, however, adjustment assemblies such as shown in these prior art references would encounter many of the same complaints mentioned above if applied in work platform application, as the platform itself would have to be lifted for vertical adjustment in substantially horizontal condition, which would likewise require support of the often cumbersome and heavy platform in a manner similar to commonly available adjustable platforms discussed above. As a consequence, despite the continuing need for conveniently adjustable work platform structures, heretofore there has not been available a platform assembly of relatively simply construction which further provided for convenient and quick in-place adjustability.

DISCLOSURE OF THE INVENTION

It is an objection of this invention to provide an improved adjustable height workstand which obviates the problems and shortcomings of adjustable work platforms and stands heretofore available in the industry.

It is also an object of the present invention to provide an adjustable height workstand which is designed to facilitate adjustment procedures and adjustability, while maintaining optimal rigidity and reliability in use.

It is yet another object of the present invention to provide an ergonomic adjustable height workstand which can be located in close proximity to a workstation and/or an assembly line, and which provides for easy vertical adjustability without a need for moving the workstand away from the workstation.

It is yet another object of the present invention to provide an improved adjustable height workstand which features a rotatable adjustable platform which can be locked in substantially horizontal use position at a variety of predetermined vertical heights, and can be rotated to an adjustment position for optimal convenience and ergonomic compatibility for adjustment procedures.

In accordance with one aspect of the present invention, there is provided an improved adjustable height workstand having a base with a front face, a pair of upstanding support columns adjacent that front face, and an adjustable platform having a front end and a relatively planar tread surface which can be adjustably fixed at a plurality of predetermined vertical heights relative to the base and support columns. The support columns include a plurality of vertically spaced and rearwardly extending adjustment slots, and the adjustable platform includes a pair of oppositely disposed adjustment members located adjacent the front end of the platform. The adjustment members each include an outwardly extending locking pin and a second locking member. The pin is selectively received in a corresponding adjustment slot and enables rotation of the adjustable platform relative to the support columns. When the platform is in substantially horizontal, or use, position, the second locking member contacts a rearward facing portion of the support column to rigidly hold the tread surface against further rotation. When vertical adjustment is desired, the support platform is rotated upwardly and toward the front of the workstand to release the second locking member and enable adjustment of the platform, whereby the pins can be moved vertically to other adjustment slots, as desired.

In a preferred embodiment, the upstanding support columns comprise generally Z-shaped channel members attached at their lower ends to the base adjacent its front end. The platform itself can be provided in the form of a lightweight grid member having a handle located adjacent the rear end of the platform to facilitate rotation of the platform between use and adjustment positions.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
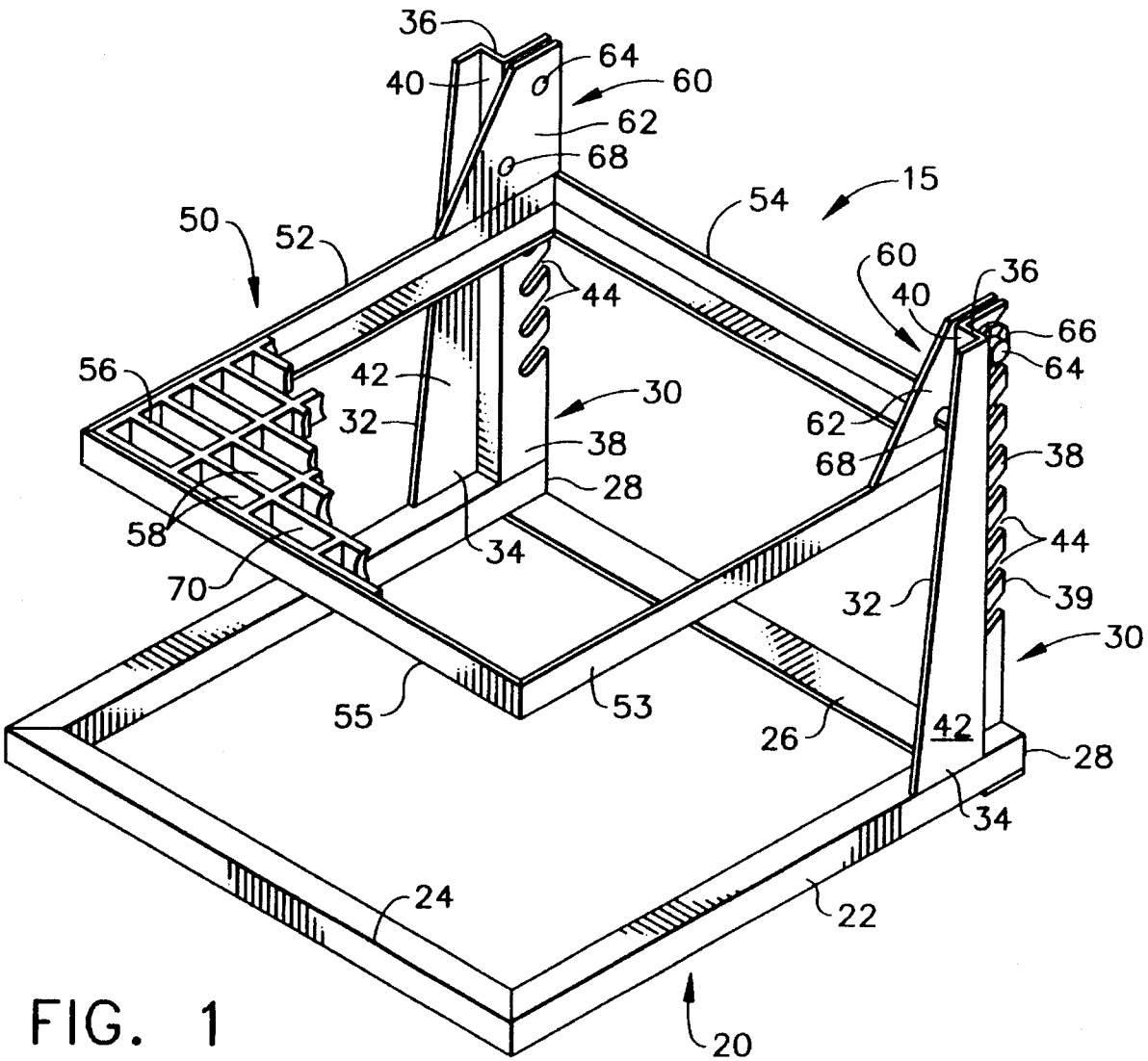
FIG. 1 is a partially broken out perspective view of an ergonomic workstand made in accordance with the present invention.

Referring now to the drawings in detail, wherein like numerals indicate the same elements throughout the views, FIG. 1 shows an adjustable height ergonomic workstand 15 made in accordance with the present invention. Workstand 15 comprises a base 20 which preferably includes a substantially skeletal frame defined by a plurality of interconnected members such as side members 22, rear cross-member 24, and front cross-member 26. Base 20 is further illustrated as having a front face 28 designed for placement in close proximity with a work area or workstation. Particularly, as will be understood, it is often desirable to provide an adjustable workstand which can be placed substantially flush with other machinery, assembly line conveyors or the like (not shown).

Workstand 15 further comprises a pair of oppositely disposed upstanding support columns 30, illustrated in FIG. 1 with a preferred construction in the form a substantially Z-shaped channel 32. Columns 30 are preferably fixed to base 20 adjacent their lower ends 34, and are shown with a distal or top end 36 spaced vertically from base 20. Support columns 30 each include a frontward facing portion 38 which may preferably have a front edge 39 which extends upwardly from base 20 substantially flush with front face 28.

Support columns 30 each further comprise a rearward facing portion 40, which is preferably defined by the outwardly angled central portion of the Z-shaped channel 32 as a relatively flat, continuous surface. Extending rearwardly from the outer edges of rearward facing portion 40 is the brace portion 42. While brace portion 42 is optional (see e.g., the generally L-shaped support column 130 of FIG. 3), this structure may be preferred in many instances to add rigidity, strength, and stability to stand 15. Support columns 30 further comprise a plurality of vertically spaced and downwardly angled adjustment slots 44 formed in frontward facing portion 38 and extending rearwardly from front edge 39.

A vertically adjustable working platform 50 is provided, and is preferably defined by a substantially skeletal platform frame 52. Frame 52 may preferably be provided in the form of a plurality of interconnected and upwardly facing open angles (e.g., angle side piece 53) for conveniently receiving a substantially planar tread surface 56. In a preferred embodiment, tread surface 56 can be provided as a lightweight grid member 58. The material from which platform 50 is provided is not critical, and may conveniently be provided in the form of reinforced fiber, high strength synthetics (such as available from Chemgrate Corporation of Woodinville, Wash.), or the like. It is also preferred that means such as handle 70 be provided to facilitate tactile access of users of the workstand 15 for adjustment procedures as will be described herein.

Figure 2:
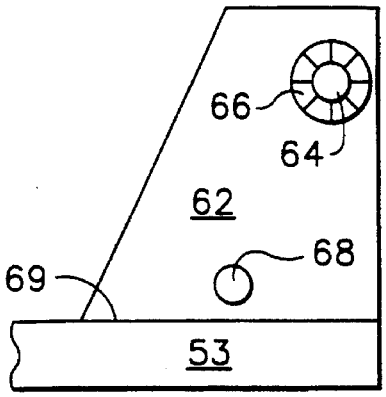
FIG. 2 is an enlarged partial side elevational view of a preferred embodiment of an adjustment member of the adjustable platform of the present invention.

Platform 50 further comprises a pair of oppositely disposed adjustment members 60, which preferably each comprise an upstanding support flange 62 connected to platform frame 52 and located adjacent front end 54 of the platform. Adjustment members 60 each further comprise a first locking member or pin 64 which extends outwardly and is selectively received within an adjustment slot 44 of the support columns 30 in use. As best seen in FIG. 2, support flange 62 might take the form of a steel plate connected to side piece 53 of platform frame 52, such as by welding or the like (e.g., along weld line 69). Each adjustment member 60 further comprises a second outwardly extending locking member or finger 68 spaced downwardly and rearwardly of first locking member 64.

Figure 4:
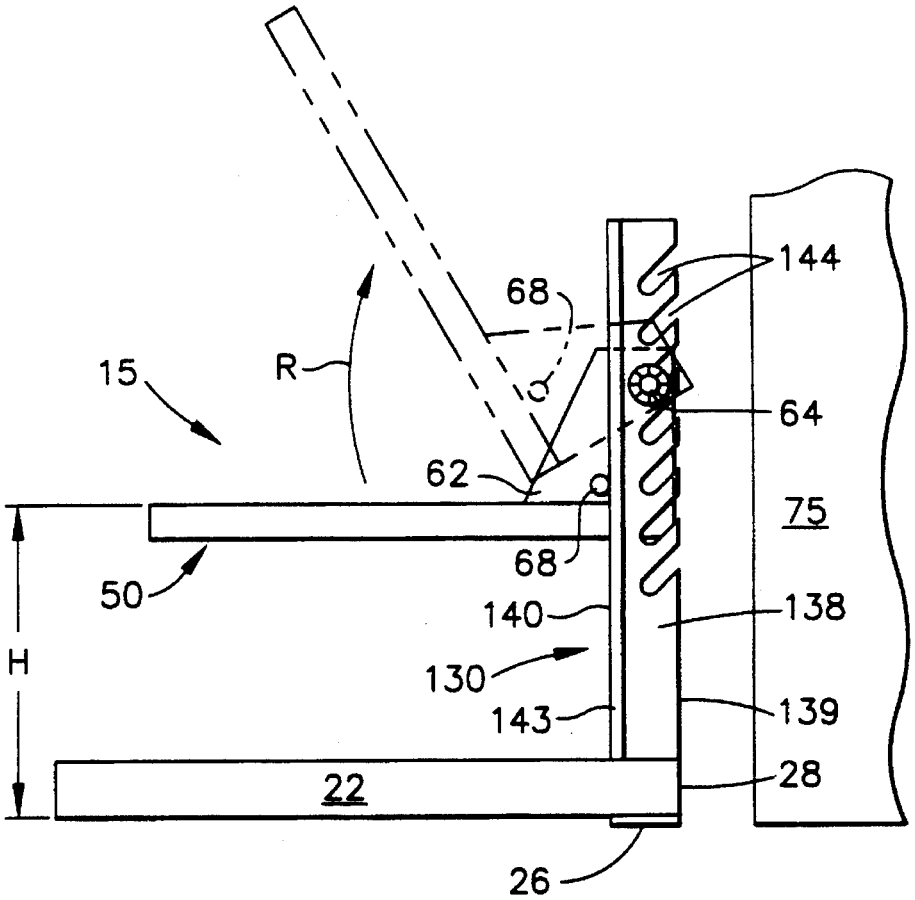
FIG. 4 is a right side elevational view of an embodiment of the ergonomic workstand of the present invention, shown with generally L-shaped support columns and illustrating the platform in use position, and in upwardly rotated position (in phantom)

As will be understood, when adjustable platform 50 is connected in its "use" position, as best seen in FIGS. 1 and 4, the respective outwardly extending first locking members 64 are received in corresponding adjustment slots 44 of the spaced support columns 30, and second locking members 68 contact the rearward facing portions 40 of columns 30 to rigidly hold tread surface 56 in substantially horizontal condition. As seen in FIGS. 1 and 2, first locking member 64 may also preferably include a retainer button or collar 66 which can help guide platform 50 and maintain substantially parallel relationship of the platform with the respective support columns, as will be discussed in greater detail below.

Figure 3:
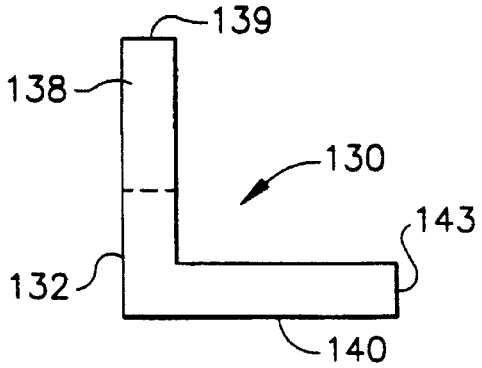
FIG. 3 is a top plan view of an alternate embodiment of a support column of the present invention.

FIG. 3 illustrates an alternate embodiment of an upstanding support column 130 made in accordance with the present invention, wherein a substantially L-shaped channel 132 is substituted for the Z-shaped channel (e.g., 32) described above. Particularly, outer edge 143 of rearward facing portion 140 is the edge along which the additional brace portion (42) of the Z-shaped channel would be attached in the Z-channel embodiment. For lighter duty applications, or where alternative methods of providing sufficient rigidity are provided, the L-shaped channel may be adequate and preferred. Support channel 130 would similarly comprise the frontward facing portion 138 having its front edge 139 essentially the same as described above with respect to support columns 30.

Figure 5:
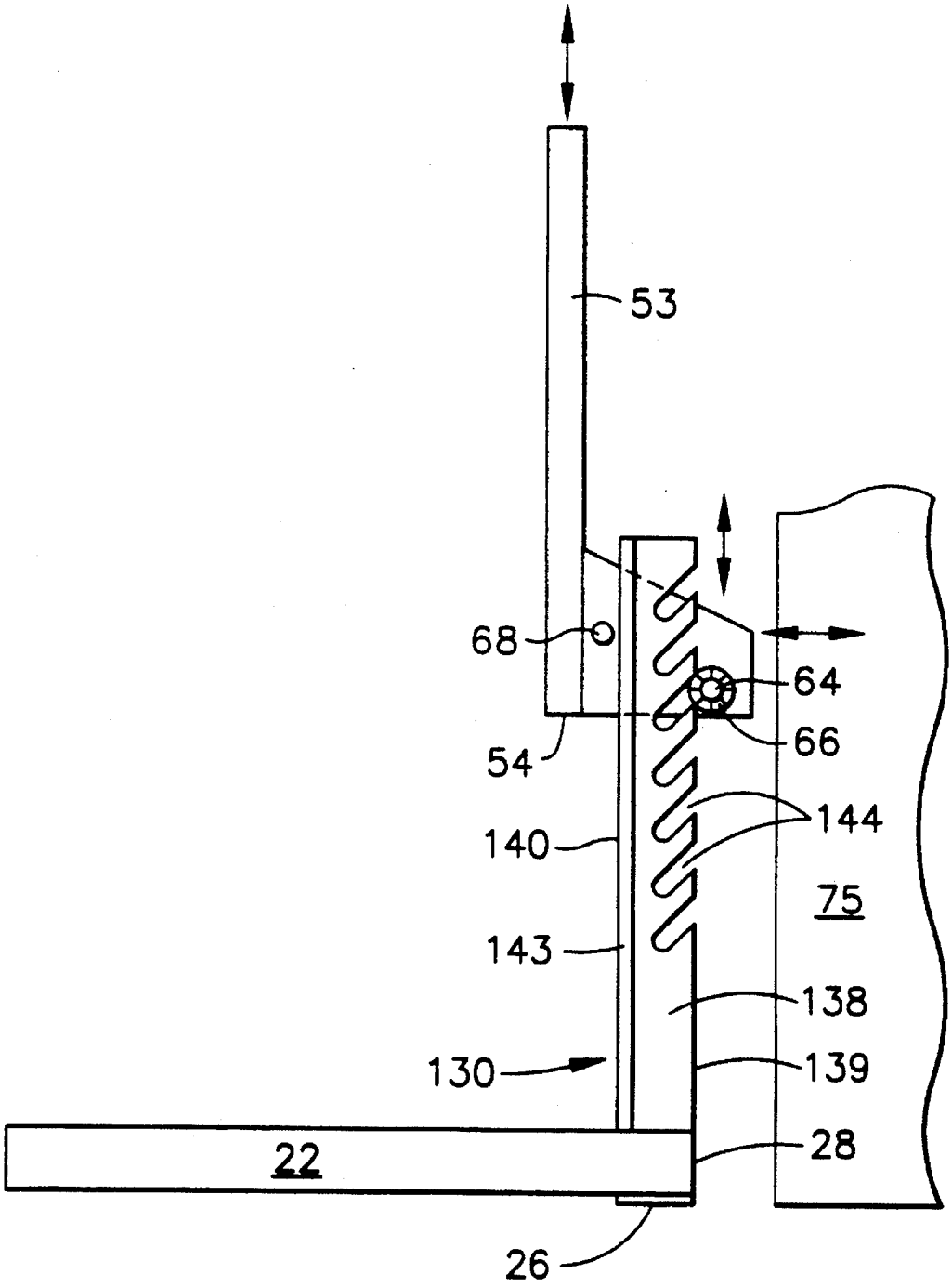
FIG. 5 is a right side elevational view of the workstand of FIG. 4, illustrating the platform member rotated into its adjustment position with its locking pins disengaged from the adjustment slots, and shown as it might appear during vertical adjustment.

FIGS. 4 and 5 illustrate the unique rocking adjustment action of the present invention, wherein adjustable platform 50 may be rotated between its use position (as illustrated in FIG. 4), and a substantially vertical adjustment position (as shown in phantom in FIG. 4, and shown in disengaged condition in FIG. 5). Particularly, FIG. 4 illustrates workstand 15 with its adjustable platform 50 rigidly locked in use position at a predetermined vertical height H. Workstand 15 is illustrated in FIGS. 4 and 5 with support columns 130 having the generally L-shaped channels 132. These support channels are shown in this illustration for clarity, as the rearwardly extending brace portions (e.g., 42 shown in FIG. 1) would obstruct a clear view of second locking member 68 in operation.

As shown in phantom in FIG. 4, in order to initiate adjustment procedures, a user would rotate platform 50 in an upward and rearward direction, as indicated by the direction arrow R. As platform 50 is rotated upwardly from its rigidly locked, cantilevered use position as shown, second locking members 68 are released from contact with rearwardly facing portion 140 of support columns 130. Due to the spacing of second locking member 68 from first locking member 64, the upward and rearward rotation of platform 50 causes second locking member 68 to be rotated rearwardly and away from rearward facing portion 140.

As best seen in FIG. 5, once second locking members 68 are rotated out of contact with rearward facing portion 140, first locking members 64 can be moved slightly forwardly to release platform 50 from the adjustment slot 144, and vertical adjustment can be easily completed by appropriate vertical movement of platform 50. It will also be appreciated that in rotated (adjustment) position, a worker can hold platform 50 relatively close the body, minimizing effective moments which could cause back injuries, muscle strains and the like. This ergonomic advantage cannot be found in any adjustable platforms which do not include the rotating or rocking locking and unlocking features of the present invention.

Once platform 50 is vertically adjusted as desired and first locking members 64 are placed within appropriate adjustment slots 44, platform 50 can be rotated rearwardly and downwardly and returned to its substantially horizontal use position, whereupon second locking members 68 will again contact rearward facing portions 140. As will also be appreciated, use of retainer buttons 66 on first locking members 64 can help retain platform 50 in general lateral alignment with support columns 130. As best seen in FIG. 5, even though first locking members 64 have been released from locking engagement with adjustment slots 144, a portion of the retainer buttons 66 continues to overlap front edge 139 of support column 130 to maintain platform 50 in lateral alignment. In this way, retainer buttons 66 prevent platform 50 from becoming "cocked" or otherwise substantially misaligned, and can help ensure that first locking members 64 can be quickly aligned with corresponding adjustment slots 144 as desired.

Having shown and described the preferred embodiments of the present invention, further adaptions of the ergonomic workstand of the present invention can be accomplished by appropriate modifications by one of ordinary skill in the art without departing from the scope of the present invention. Several of these potential modifications have been mentioned, and others will become apparent to those skilled in the art. Accordingly, the scope of the present invention should be considered in terms of the following claims, and is understood not to be limited to the details of structure and function shown and described in the specification and drawings.

I claim:

1. A portable adjustable height work stand for accommodating workers of various stature and work heights comprising:

a base having a front face;

a pair of upstanding support columns attached to said base, said columns each further comprising a frontward facing portion and a rearward facing portion, and having a plurality of vertically spaced adjustment slots formed therein, said slots are angled rearwardly and downwardly toward said base from said frontward facing portion; and an adjustable platform member having a front end, a relatively planar tread surface, and a pair of oppositely disposed adjustment members located adjacent said front end and each of said adjustment members supporting first and second outwardly extending locking members, said platform member rotatable relative to said support columns about said first locking members, each of said first locking members is selectively received in one of said adjustment slots, and said second locking member spaced rearwardly from said first member and contacting said rearward facing portion of said support column in use to rigidly hold said tread surface in substantially horizontal, cantilevered position relative to said support column, and wherein said platform member is rotated upwardly and forwardly for adjustment releasing said second locking member from contact with said rearwardly facing portion of said support column and said first locking members can thereafter be selectively removed from said slots such that said platform member can be manually vertically adjusted as desired.

2. The work stand of claim 1, wherein said support columns each comprise L-shaped channels having upper and lower ends, with said lower ends being fixed to said base adjacent said front face.

3. The work stand of claim 1, wherein said support columns comprise Z-shaped members having upper and lower ends, with said lower ends being fixed to said base adjacent said front end.

4. The work stand of claim 1, wherein said platform comprises a relatively skeletal frame, and said adjustment members comprise a flange attached to said frame adjacent said front end, and said first and second locking members extend outwardly from said flange.

5. The work stand of claim 4, wherein said tread surface of said platform further comprises a lightweight grid member located within said frame.

6. A portable adjustable height work stand for accommodating workers of various stature and work heights comprising:

a base having a front face;

a pair of upstanding support columns attached to said base, said columns each further comprising a frontward facing portion and a rearward facing portion, a plurality of vertically spaced adjustment slots formed therein, said slots are angled rearwardly and downwardly toward said base from said frontward facing portion; and an adjustable platform member having a front end, a relatively planar tread surface, and a pair of oppositely disposed adjustment members located adjacent said front end and each of said adjustment members having a flange supporting first and second outwardly extending locking members, said platform member rotatable relative to said support columns about said first locking members, said first locking members each comprising a pin which is selectively received in one of said adjustment slots, and said second locking member is spaced rearwardly from said first member and contacts said rearward facing portion of said support column in use to rigidly hold said tread surface in substantially horizontal, cantilevered position relative to said support column, and wherein said platform member is rotated upwardly and forwardly for adjustment releasing said second locking member from contact with said rearwardly facing portion of said support column and said first locking members can thereafter be vertically adjusted to other adjustment slots as desired.

7. The work stand of claim 6, wherein said support columns each comprise L-shaped channels having upper and lower ends, with said lower ends being fixed to said base adjacent said front face.

8. The work stand of claim 6, wherein said support columns comprise Z-shaped members having upper and lower ends, with said lower ends being fixed to said base adjacent said front end.

9. The work stand of claim 6, wherein said platform comprises a relatively skeletal frame.

10. The work stand of claim 9, wherein said tread surface of said platform further comprises a lightweight grid member located within said frame.

11. An improved adjustable height work stand comprising a base having a front face, a pair of upstanding support columns attached to said base each having a frontward facing portion and a rearward facing portion, and comprising a plurality of spaced adjustment slots spaced therein, said slots are angled rearwardly and downwardly toward said base from said frontward facing portion, and an adjustable platform member having a front end and a relatively planar tread surface, said platform member being vertically adjustable on said support columns, and said adjustment platform comprises a pair of oppositely disposed adjustment members located adjacent said front end, each of said adjustment members having a flange supporting first and second outwardly extending locking members, said first locking members each comprising a pin which is selectively received in one of said adjustment slots and enabling rotation of said platform relative to said support column thereabout between a substantially horizontal use portion and a substantially vertical adjustment position, and said second locking member spaced rearwardly from said first member and contacting said rearward facing portion of said support column when said platform is rotated to the horizontal use position to rigidly hold said tread surface in substantially horizontal, cantilevered position relative to said support column, and said second locking member being released from contact with said rearwardly facing portion of said support column when said platform is rotated to adjustment position and said first locking members can thereafter be vertically adjusted to other adjustment slots as desired.

12. The work stand of claim 11, wherein said platform comprises a relatively skeletal frame.

13. The improved work stand of claim 11, wherein said support columns each comprise L-shaped channels having upper and lower ends, with said lower ends being fixed to said base adjacent said front face.

14. The work stand of claim 11, wherein said support columns comprise Z-shaped members having upper and lower ends, with said lower ends being fixed to said base adjacent said front end.

15. The work stand of claim 11, wherein said tread surface of said platform further comprises a lightweight grid member located within said frame.

16. The work stand of claim 15, wherein said platform further comprises a rear end, and a handle located adjacent said rear end for facilitating rotation of said platform between its use and adjustment positions.

* * * * *